US011433684B2

(12) United States Patent
Nedelin et al.

(10) Patent No.: US 11,433,684 B2
(45) Date of Patent: Sep. 6, 2022

(54) PRINT APPARATUSES USING REUSABLE PRINT AGENT CONTAINERS

(71) Applicant: Hewlett-Packard Development Company, L.P., Spring, TX (US)

(72) Inventors: Peter Nedelin, Ness Ziona (IL); Mark Sandler, Ness Ziona (IL); Assaf Pines, Ness Ziona (IL); Shai Lior, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/051,094

(22) PCT Filed: Aug. 22, 2018

(86) PCT No.: PCT/US2018/047544
§ 371 (c)(1),
(2) Date: Oct. 27, 2020

(87) PCT Pub. No.: WO2020/040759
PCT Pub. Date: Feb. 27, 2020

(65) Prior Publication Data

US 2021/0232059 A1 Jul. 29, 2021

(51) Int. Cl.
*B41J 2/175* (2006.01)
*B41J 2/17* (2006.01)
(Continued)

(52) U.S. Cl.
CPC ..... *B41J 2/17596* (2013.01); *B41J 2/175* (2013.01); *B41J 2/1707* (2013.01);
(Continued)

(58) Field of Classification Search
CPC ..... G03G 15/104; G03G 15/105; G03G 15/11
See application file for complete search history.

(56) References Cited

U.S. PATENT DOCUMENTS 4,860,050 A * 8/1989 Kurotori ..... G03G 9/12 399/238
4,874,515 A 10/1989 McKelvey
(Continued)

FOREIGN PATENT DOCUMENTS

EP 0597628 A1 5/1994
EP 1361066 11/2003
(Continued)

*Primary Examiner* — Jessica L Eley
(74) *Attorney, Agent, or Firm* — Fabian VanCott

(57) ABSTRACT

A print apparatus is disclosed. The print apparatus comprises a container-receiving unit for receiving a reusable print agent container; a print agent reservoir for storing print agent to be consumed by the print apparatus during a printing operation; a pump for transferring print agent between a reusable print agent container positioned in the container-receiving unit and the print agent reservoir; and processing circuitry. The processing circuitry is to operate the pump to transfer print agent of a first concentration from the reusable print agent container to the print agent reservoir; and, responsive to determining that a volume of print agent of the first concentration in the reusable print agent container has fallen below a threshold volume, operate the pump to transfer a volume of print agent of a second, lower concentration from the print agent reservoir to the reusable print agent container. A method and a machine-readable medium are also disclosed.

20 Claims, 5 Drawing Sheets

(51) Int. Cl.
*B41J 2/18* (2006.01)
*G03G 15/08* (2006.01)
*G03G 15/10* (2006.01)

(52) U.S. Cl.
CPC ..... *B41J 2/17566* (2013.01); *B41J 2/18* (2013.01); *G03G 15/0849* (2013.01); *G03G 15/0894* (2013.01); *G03G 15/105* (2013.01)

(56) References Cited

U.S. PATENT DOCUMENTS 5,463,453 A * 10/1995 Kurotori ..... G03G 9/125 430/114
5,930,555 A 7/1999 Lee
6,318,259 B1 11/2001 Chou et al.
6,542,704 B2 4/2003 Suetsugu
6,694,112 B2 2/2004 Sasaki et al.
7,171,143 B2 1/2007 Yamasaku
7,831,179 B2 11/2010 Oda
8,270,880 B2 * 9/2012 Kato ..... G03G 21/12 399/238
8,301,043 B2 10/2012 Hobo et al.
8,398,217 B2 * 3/2013 Manders ..... B41J 2/17596 347/85
9,417,562 B2 * 8/2016 Komatsuzaki ..... G03G 15/105
2011/0050766 A1 * 3/2011 Matsumoto ..... B41J 2/195 347/7
2012/0294653 A1 * 11/2012 Gomi ..... G03G 15/11 399/249

FOREIGN PATENT DOCUMENTS

EP 2516167 A1 10/2012
EP 2670599 A1 12/2013
WO WO-2009144040 12/2009
WO 2011/076810 A1 6/2011
WO 2012/105938 A1 8/2012

* cited by examiner

PRINT APPARATUSES USING REUSABLE PRINT AGENT CONTAINERS

BACKGROUND

In some print apparatuses, solid printing material or solid print agent (e.g. solid ink) is combined with liquid carrier in particular proportions so as to form print agent having an intended concentration. Some print apparatuses consume the print agent from a print agent tank at a concentration higher than the concentration at which it is provided to the print agent tank. In such examples, unused, redundant liquid carrier may be fed back into the print agent tank.

BRIEF DESCRIPTION OF DRAWINGS

Examples will now be described, by way of non-limiting example, with reference to the accompanying drawings, in which.

DETAILED DESCRIPTION

The present disclosure relates to a mechanism by which a reusable container may be used for storing print agent, such as ink, to be used by a print apparatus in performing a printing operation. Use of a reusable container may help to reduce waste associated with excess or redundant materials consumed by the print apparatus.

Figure 1:
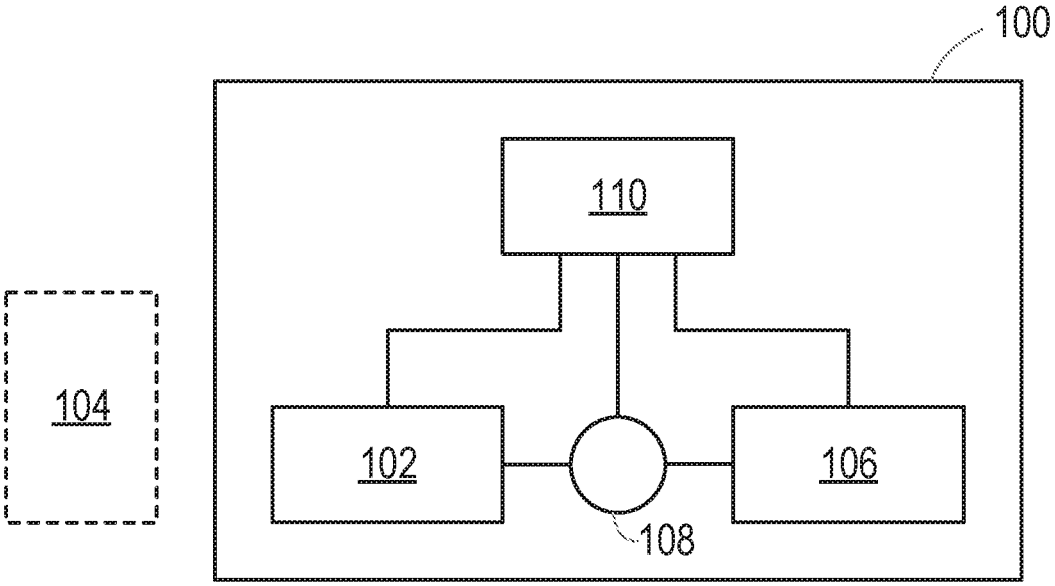
FIG. 1 is a simplified schematic of an example of a print apparatus for using a reusable print agent container.

An aspect of the present disclosure relates to a print apparatus. FIG. 1 is a simplified schematic of an example of a print apparatus 100. The print apparatus 100 may use a reusable print agent container (also referred to as an ink canister). The print apparatus 100 may, for example, comprise a two-dimensional print apparatus or a three-dimensional print apparatus. A two-dimensional print apparatus may deposit print agent, such as ink, from a print agent distributor, such as an print agent cartridge, via nozzles onto a printable medium, such as paper, cardboard, glass, plastics, or the like. A three-dimensional print apparatus, also referred to as an additive manufacturing apparatus, may be used to generate three-dimensional objects on a layer-by-layer basis. Print agent may be deposited onto a layer of build material formed on a print bed. Each layer of build material may be solidified to form the intended three-dimensional object.

In some examples, the print apparatus 100 may comprise a liquid electrophotography (LEP) print apparatus. In an LEP print apparatus, print agent may be stored in a binary ink developer (BID). Print agent from a BID is selectively transferred from a developer roller of the BID in a layer of substantially uniform thickness to a photo imaging plate (PIP). The selective transfer of print agent may be achieved through the use of electrically-charged print agent. The entire PIP may be charged, then areas representing an image to be printed may be discharged, for example by forming a latent image on the PIP using a laser beam. Print agent is transferred to those portions of the PIP that have been discharged. The PIP may transfer the print agent to an intermediate transfer member (ITM) which may be covered by a replaceable print blanket. The print agent may subsequently be transferred onto a printable substrate, such as paper.

The print apparatus 100 comprises a container-receiving unit 102 for receiving a reusable print agent container 104. The reusable print agent container 104 is shown with a dashed outline in FIG. 1 to indicate that it does not form a part of the apparatus 100. The reusable print agent container 104 may have a size and/or shape appropriate to the print apparatus 100. In some examples, the reusable print agent container 104 may have a size and/or shape complementary to a size and/shape of the container-receiving unit 102. The container-receiving unit 102 and/or the reusable print agent container 104 may be such that, when the reusable print agent container is installed, positioned or located in the container-receiving unit, print agent contained within the reusable print agent container is able to transfer from the reusable print agent container to another component of the print apparatus 100, via suitable print agent transfer components, such as an aperture and a pipe or conduit.

The print apparatus 100 also comprises a print agent reservoir 106 for storing print agent to be consumed by the print apparatus during a printing operation. A printing operation performed by the print apparatus 100 may be considered to be any operation whereby the print agent is consumed by the print apparatus. For example, a printing operation may involve print agent being deposited or transferred onto a printable medium, for example via a roller or series of rollers. The container-receiving unit 102 and print agent reservoir 106 may be coupled to one another, or otherwise in communication with one another, via a suitable mechanism, such as a pipe or conduit.

The print apparatus 100 further comprises a pump 108 for transferring print agent between a reusable print agent container 104 positioned in the container-receiving unit 102 and the print agent reservoir 106. The pump 108 may comprise any pump suitable for causing print agent to move from the reusable print agent container 104 the print agent reservoir 106 and/or from the print agent reservoir to the reusable print agent container. The pump 108 may, for example, transfer print agent between the reusable print agent container 104 and the print agent reservoir 106 via a pipe or conduit, or via a series or network of pipes or conduits. In some examples, the pump 108 may comprise a gear pump while, in other examples, the pump may comprise some other type of pump.

The print apparatus 100 further comprises processing circuitry 110. The processing circuitry 110 may be in communication with the container-receiving unit 102, the reusable print agent container 104 when positioned in the container-receiving unit, the print agent reservoir 106 and/or the pump 108. The processing circuitry 110 is to operate the pump 108 to transfer print agent of a first concentration from the reusable print agent container 104 to the print agent reservoir 106. For example, the processing circuitry 110 may send a signal (e.g. an activation signal) to the pump 108 causing activation of the pump, so that print agent is able to flow from the reusable print agent container 104 to the print agent reservoir 106. Thus, print agent may be provided to the print apparatus 100 in the reusable print agent container 104 at the first concentration.

The processing circuitry 110 is further to, responsive to determining that a volume of print agent of the first concentration in the reusable print agent container 104 has fallen below a threshold volume, operate the pump to transfer a volume of print agent of a second, lower concentration from the print agent reservoir 106 to the reusable print agent container 104. Thus, the processing circuitry 110 may determine when the volume of print agent of the first concentration in the reusable print agent container 104 drops to below a threshold volume. In some examples, the threshold volume may be 1 cubic centimetre ($cm^3$), or 0.5 $cm^3$, such that the processing circuitry 110 is able to determine when the reusable print agent container 104 is empty or substantially empty. In other examples, solid print agent may be added to the reusable print agent container 104 and the print agent density monitored. If it is determined that the density of print agent in the reusable print agent container 104 does not increase after a defined period of time, then it may be determined that the reusable print agent container is empty (e.g. that the reusable print agent container contains less than a threshold amount of print agent). A determination that the reusable print agent container 104 is empty, or substantially empty (or has otherwise fallen below a threshold volume), may be indicative that all (or a threshold amount) of the print agent of the first concentration in the reusable print agent container has been transferred into the print agent reservoir 106.

Once the processing circuitry 110 has determined that the threshold volume of print agent of the first concentration has been removed from the reusable print agent container 104 (e.g. once it has been determined that the reusable print agent container is empty or substantially empty), a volume of print agent contained in the print agent reservoir 106 is pumped into the reusable print agent container. The print agent moved from the print agent reservoir 106 to the reusable print agent container 104 is at a lower concentration than the print agent that is transferred from the reusable print agent container to the print agent reservoir. The reason for this is that liquid carrier, such as imaging oil, is added to the print agent in the print agent reservoir 106 in order to reduce its concentration. In one example, print agent in the reusable print agent container 104 has a concentration of around 16% and, after additional liquid carrier has been added to the print agent in the print agent reservoir 106, the concentration of the print agent in the print agent reservoir is reduced to around 2%. Thus, the print agent transferred from the print agent reservoir 106 to the reusable print agent container 104 in this example has a concentration of around 2% (i.e. lower than the print agent concentration of 16% when it was transferred from the reusable print agent container to the print agent reservoir). By reducing the concentration of the print agent to around 2%, print agent particles experience high mobility in an electric field, which is appropriate for example in an LEP print apparatus. Furthermore, at a low concentration (e.g. around 2%), the print agent behaves like a liquid, rather than a paste, which makes the print agent suitable for use in some print apparatuses.

Removing a volume of print agent from the print agent reservoir 106 may help to restrict the volume of print agent in the print agent reservoir, and may prevent print agent in the print agent reservoir from overflowing. Removing some of the low-concentration print agent from the print agent reservoir 106 may help to maintain the level of print agent in the print agent reservoir below a threshold level; if the amount of print agent were to rise above the threshold level, it may be appropriate to drain some print agent from the print agent reservoir. Thus, if some of the print agent is not removed from the print agent reservoir 106 automatically in the manner described above, then it may be that an operator has to perform a manual removal procedure to remove a volume of print agent from the print agent reservoir. Such a manual procedure may result in any pending printing operations of the print apparatus 100 being paused or halted, thereby resulting in downtime of the print apparatus. Thus, the automatic removal of print agent by the presently-disclosed apparatus 100 may lead to the reduced downtime of the print apparatus, and a reduction in wastage resulting from the low-concentrated print agent being removed from print agent reservoir 106 and not reused.

In some examples, the processing circuitry 110 may be further to operate the print apparatus 100 to consume print agent from the print agent reservoir 106 for delivery to a printable substrate. Thus, the processing circuitry 110 may control or operate components within the print apparatus 100 to cause print agent in the print agent reservoir 106 to be deposited or printed onto a printable substrate, such as paper, for example via nozzles of a print head. The processing circuitry 110 may, in some examples, be to operate the print apparatus 100 to consume the print agent at a concentration greater than the concentration of the print agent in the reusable print agent container 104. For example, print agent in the reusable print agent container 104 may have a concentration of around 16%. As noted above, print agent transferred from the reusable print agent container 104 to the print agent reservoir 106 may be diluted using liquid carrier to a concentration of around 2%. In some examples, the print apparatus 100 may consume print agent having a concentration of around 22%. Therefore, the print apparatus 100 may extract print agent at a higher concentration from the print agent in the print agent reservoir 106. A consequence of the higher-concentration print agent being extracted from the print agent in the print agent reservoir 106 is that excess or redundant liquid carrier (or low-concentration print agent) accumulates in the print agent reservoir, rather than being consumed during the printing operation. This may lead to an overflow of the print agent reservoir, as discussed above.

The example print agent concentrations noted above relate to specific examples, and are included for illustrative purposes. More generally, the first concentration (i.e. the concentration of print agent to be transferred from the reusable print agent container 104 to the print agent reservoir 106) may comprise a concentration of between around 5% and 100% by weight. In some examples, the first concentration may comprise a concentration of between around 5% and 75%. The second concentration (i.e. the concentration of print agent to be transferred from the print agent reservoir 106 to the reusable print agent container 104) may comprise a concentration of between around 2% and 7% by weight.

Figure 2:
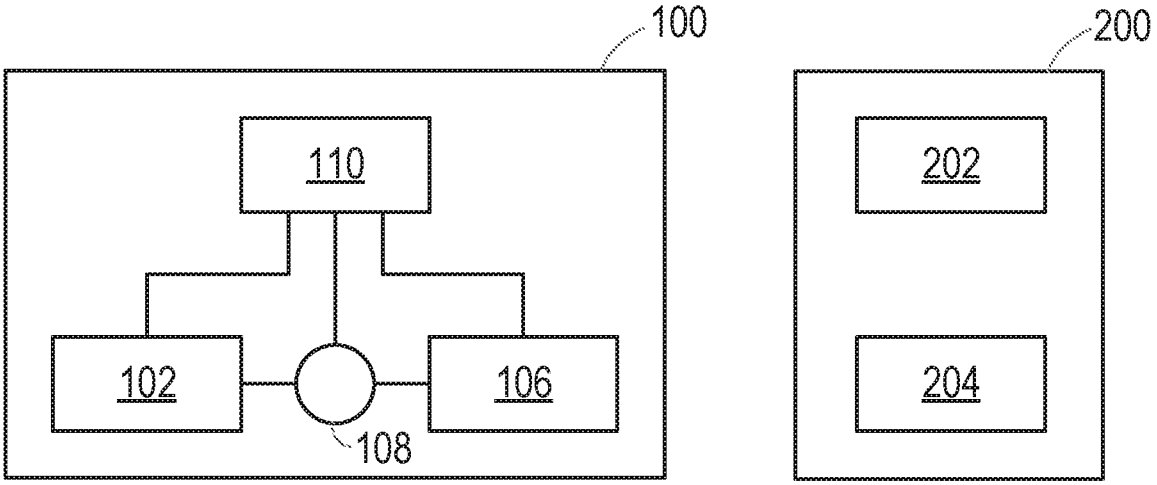
FIG. 2 is a simplified schematic of an example of a print apparatus for using a reusable print agent container and a mixing apparatus.

FIG. 2 is a simplified schematic of an example of the print apparatus 100 and a mixing apparatus 200. According to some examples disclosed herein, the print apparatus 100 and the mixing apparatus 200 may be used together for the preparation and use of a reusable print agent container, such as the container 104.

The mixing apparatus 200 may comprise a container-receiving unit 202 for receiving a reusable print agent container, such as the reusable print agent container 104. The container-receiving unit 202 may be similar (in terms of its size, shape and/or function) to the container-receiving unit 102 described herein. The mixing apparatus 200 may further comprise a mixer 204 to mix, or disperse, solid print agent in liquid carrier and/or in print agent. The mixer 204 may be in fluid communication with the container-receiving unit 202 and/or with a reusable print agent container (e.g. 104) positioned in the container receiving unit 202. In this way, print agent contained within the reusable print agent container 104 may be transferred to the mixer 204, and print agent prepared in the mixer 204 may be transferred to the reusable print agent container 104.

The mixer 204 may be supplied with inputs (not shown) for providing solid print agent and liquid carrier (e.g. imaging oil) to the mixer from respective reservoirs or sources (not shown). The mixer 204 may comprise components suitable for combining the solid print agent with the liquid carrier to form print agent of an intended concentration. In some examples, the mixer 204 may comprise a high-shear mixer.

The mixing apparatus 200 may be in a location remote from the print apparatus 100. In this way, mixing (e.g. print agent preparation) may be performed offline with respect to the print apparatus. Thus, a new batch of print agent may be prepared without interrupting an ongoing print operation being performed by the print apparatus 100. Furthermore, using the print apparatus 100 disclosed herein, high-concentration, or ultra-high-concentration, solid print agent (e.g. solid print agent having a concentration of around 75% by weight) may be combined with liquid carrier (e.g. in the mixing apparatus 200) to create print agent of a lower concentration to suit the concentration of print agent used by the print apparatus 100 (e.g. around 2%). Therefore, high-concentration solid print agent may be used to prepare print agent for existing print apparatuses, such that the print apparatus is not to be modified in any way to be suitable to using high-concentration solid print agent.

Print agent prepared to an intended concentration (e.g. the first concentration) in the mixer 204 may be transferred to a reusable print agent container 104 positioned in the container-receiving unit 202. The reusable print agent container 104 may then be removed from the container-receiving unit 202 and installed or positioned in the container-receiving unit 102 of the print apparatus 100. As described above, print agent may be transferred from the reusable print agent container 104 to the print agent reservoir 106, using the pump 108, and print agent of a second, lower concentration may be transferred from the print agent reservoir to the reusable print agent container. The reusable print agent container 104 may then be removed from the container-receiving unit 102 of the apparatus 100 and installed or positioned in the container-receiving unit 202 of the mixing apparatus 200. The print agent contained within the reusable print agent container 104 may be transferred from the reusable print agent container to the mixer 204 for use in the preparation of more print agent of an intended concentration. The use of a reusable print agent container 104 helps to reduce waste compared to a non-reusable container, which might be disposed of once emptied. Furthermore, as noted above, print agent transferred from the print agent reservoir 106 may be reused in the preparation of a new batch of print agent, rather than being drained from the print agent reservoir, and disposed of.

Figure 3:
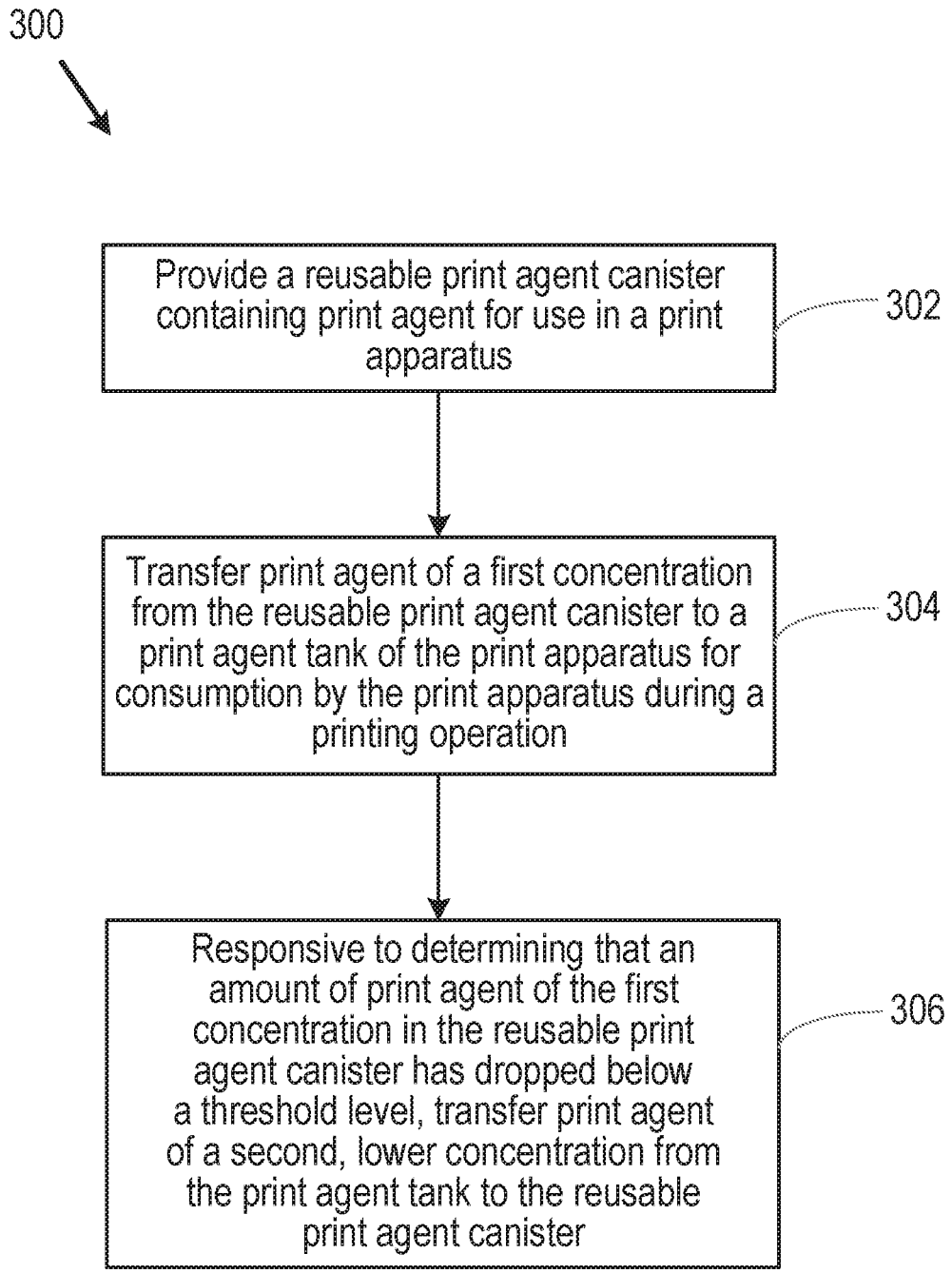
FIG. 3 is a flowchart of an example of a method of using a reusable print agent container.

A further aspect of the present disclosure relates to a method of using a reusable print agent container. FIG. 3 is a flowchart of an example of a method 300. The method 300 may be considered to be a method of using a reusable print agent container or canister. The method 300 comprises, at block 302, providing a reusable print agent canister containing print agent for use in a print apparatus. The reusable print agent canister may comprise or be similar to the reusable print agent container 104 discussed herein.

At block 304, the method 300 comprises, transferring print agent of a first concentration from the reusable print agent canister to a print agent tank of the print apparatus for consumption by the print apparatus during a printing operation.

The method 300 comprises, at block 306, responsive to determining that an amount of print agent of the first concentration in the reusable print agent canister has dropped below a threshold level, transferring print agent of a second, lower concentration from the print agent tank to the reusable print agent canister. The transfer of print agent from the reusable print agent canister to the print agent tank (block 304) and from the print agent tank to the reusable print agent canister (block 306) may be performed using the pump 108, as described above. The threshold level of print agent in the reusable print agent canister may, in some examples, be a low level (e.g. 0.5 $cm^3$, 1 $cm^3$, 2 $cm^3$ or the like) such that it may be determined that the all, or substantially all of the print agent in the reusable print agent canister has been transferred into the print agent tank, and the reusable print agent canister is, effectively, empty. When this determination has been made, a volume of print agent at the second concentration, which is lower than the first concentration, is transferred from the print agent tank to the reusable print agent canister. As discussed above, removing a volume of print agent from the print agent tank (which can be used in a preparation of a new batch of print agent) may help prevent the print agent tank overflowing and, as a result, the print apparatus can continue to operate without the print agent tank being manually drained (i.e. without an operator stopping the print apparatus so that some of the print agent in the print agent tank can be removed manually).

Figure 4:
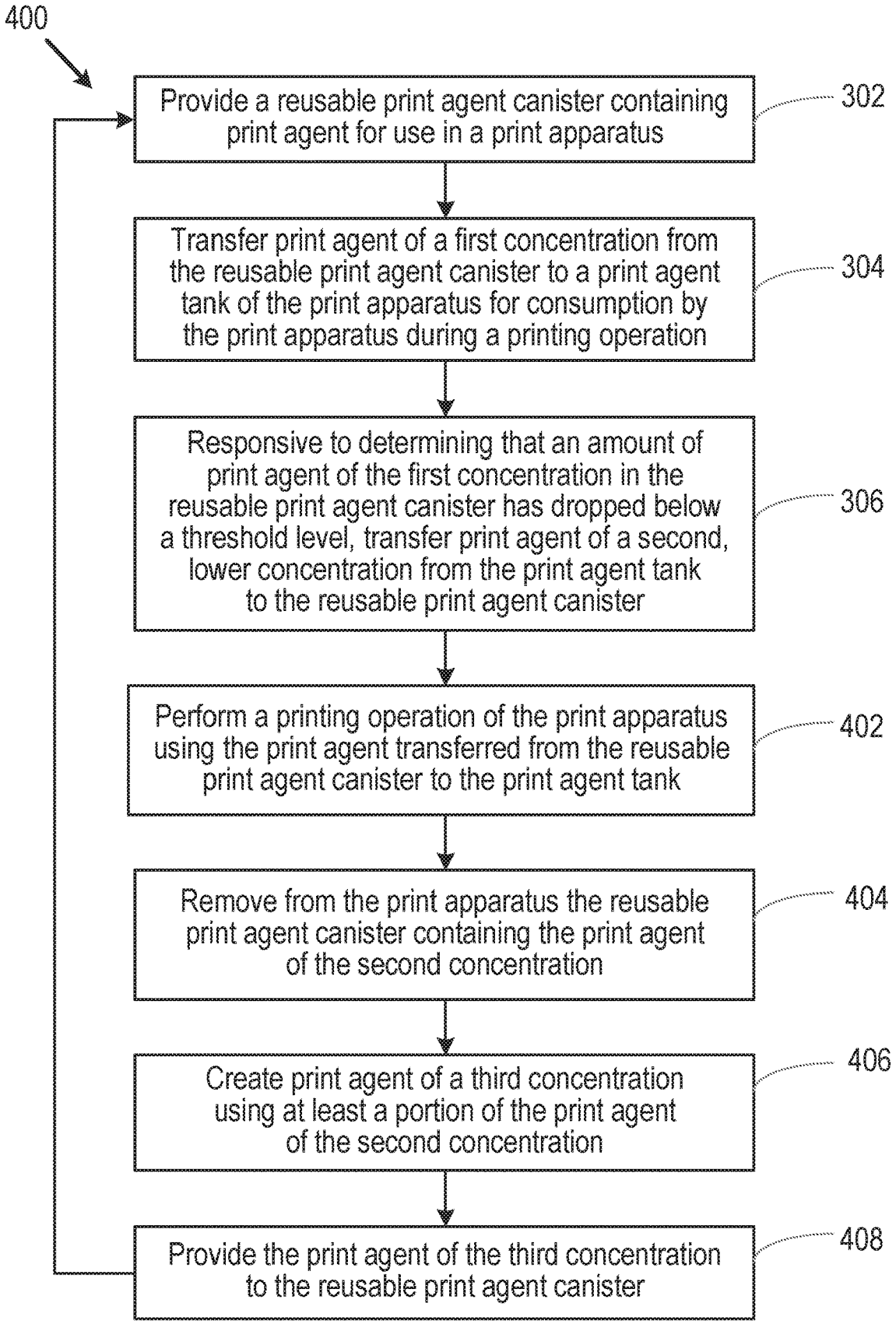
FIG. 4 is a flowchart of a further example of a method of using a reusable print agent container.

FIG. 4 is a flowchart of a further example of a method 400. The method 400 may be considered to be a method for using a reusable print agent container. The method 400 may comprise blocks of the method 300 discussed above. The method 400 may further comprise, at block 402, performing a printing operation of the print apparatus using the print agent transferred from the reusable print agent canister to the print agent tank. Thus, print agent may be provided to the print apparatus 100 (e.g. to the print agent tank 106 of the print apparatus) using the reusable print agent canister 104, and that print agent may be used in the printing operation (e.g. printing an image onto a printable substrate).

In some examples, the print agent used for the printing operation may be consumed at a concentration higher than the first concentration of the print agent in the reusable print agent canister. Thus, print agent of the first, relatively high, concentration (e.g. 16% by weight) is transferred from the reusable print agent canister 104 to the print agent tank 106 of the print apparatus 100. Additional liquid carrier (e.g. imaging oil) may be added to the print agent in the print agent tank 106 in order to reduce its concentration to the second concentration (e.g. 2% by weight). The print apparatus 100 may then consume print agent from the print agent tank at a higher concentration (e.g. 22% by weight) for the printing operation. In some examples, the print apparatus 100 may extract the higher-concentration print agent from the print agent in the print agent tank 106 when it is consumed by the print apparatus. For example, in an LEP print apparatus, print agent particles from the higher-concentration print agent may be transferred to a roller in the presence of an electric field, and excess liquid carrier, which is not transferred to the roller, may be drained back into the print agent tank.

The volume of print agent to be transferred from the print agent tank to the reusable print agent canister may be chosen based on the print apparatus in which the print agent is to be used, and/or based on other factors, such as the printing operation to be performed, a print mode (e.g. e.g. parameters of the printing apparatus), the size of the print agent tank 106, and/or the nature of the print agent (e.g. the print agent concentration). The volume of print agent to be transferred may be defined by a user. In some examples, transferring print agent of the second concentration from the print agent tank 106 to the reusable print agent canister 104 may comprise transferring between around 300 $cm^3$ and 600 $cm^3$ of print agent of the second concentration from the print agent tank to the reusable print agent canister. In some examples, around 500 $cm^3$ of print agent of the second concentration may be transferred.

Once the volume of print agent (e.g. a defined volume, such as between 300 cm3 and 600 cm3, has been transferred from the print agent tank 106 to the reusable print agent canister 104, the reusable print agent canister may be removed and used to prepare a further volume (e.g. a new batch) of print agent. Thus, the method 400 may further comprise, at block 404, removing from the print apparatus 100 the reusable print agent canister 104 containing the print agent of the second concentration. At block 406, the method 400 may further comprise creating print agent of a third concentration using at least a portion of the print agent of the second concentration. This may be achieved by transferring the print agent of the second concentration from the reusable print agent canister to a mixer (e.g. the mixer 204), and adding more solid print agent and liquid carrier to be mixed along with the print agent of the second concentration. Thus, in some examples, creating print agent of a third concentration may comprise combining at least a portion of the print agent of the second concentration, liquid carrier and solid print agent. Creating print agent of the third concentration may, in some examples, comprise combining the print agent of the second concentration, the liquid carrier and the solid print agent using a high-shear mixer (e.g. the mixer 204). The third concentration may, in some examples, be the same as the first concentration (e.g. if more print agent is to be created for the current printing operation). In other examples, the third concentration may be different to the first concentration (e.g. if the print agent of the third concentration is to be used in a new printing operation).

The mixing apparatus 200 may, in some examples, be located near to the print apparatus 100 (e.g. at the same site, or in the same room as the print apparatus), such that the reusable print agent canister 104 can be reused quickly, without being transported to another site, for example.

The method 400 may comprise, at block 408, providing the print agent of the third concentration to the reusable print agent canister 104. Thus, the newly-created print agent may be placed in the reusable print agent canister 104, transported to the print apparatus 100, transferred into the print agent tank 106 and used in a printing operation. Thus, the method 400 may repeat, such that the method continues with block 302 following block 408.

Figure 5:
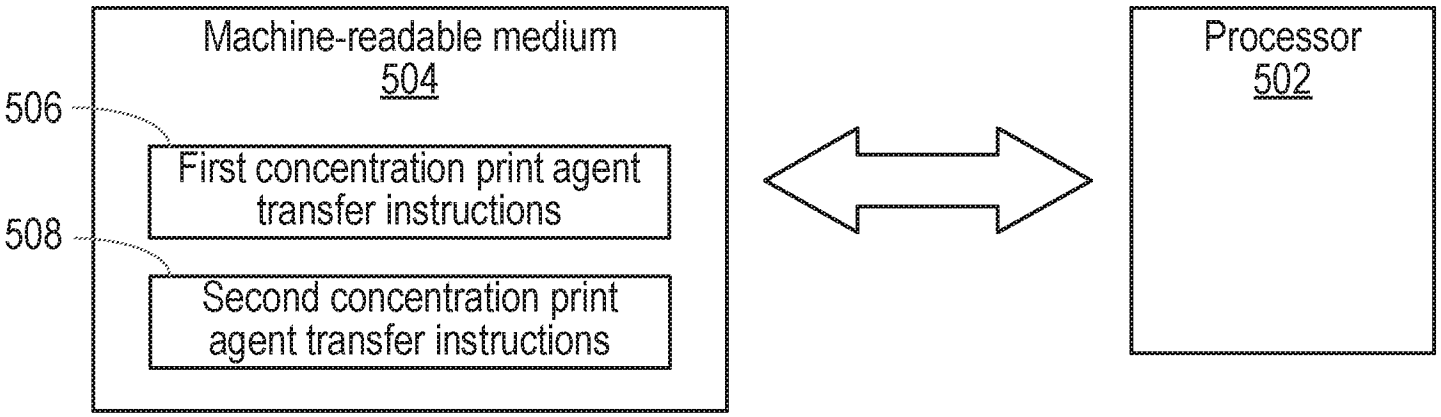
FIG. 5 is a simplified schematic of an example of a machine-readable medium and a processor.

A further aspect of the disclosure relates to a machine-readable medium. FIG. 5 is a simplified schematic of an example of a processor 502 and a machine-readable medium 504. The machine-readable medium 504 comprises instructions which, when executed by a processor, cause the processor to perform parts of the methods disclosed herein. In some examples, the machine-readable medium comprises instructions which, when executed by a processor, cause the processor to control a pump to transfer print agent of a first concentration from a reusable print agent container to a print agent tank of a print apparatus for use in a print operation. The print apparatus is to use the print agent at a concentration higher than the first concentration. The processor 502 may execute instructions stored on the machine-readable medium 504, such as first concentration print agent transfer instructions 506. The machine-readable medium 504 comprises instructions (e.g. second concentration print agent transfer instructions 508) which, when executed by a processor, cause the processor to, in response to determining that the volume of print agent in the reusable print agent container has reduced to below a threshold level, control the pump to transfer a defined volume of print agent of a second concentration from the print agent tank to the reusable print agent container. The second concentration is lower than the first concentration. Thus, the processor 504 may control the pump 108 to transfer print agent between the print agent tank 106 and the reusable print agent canister 104. The processor 504 may, in some examples, form part of the print apparatus 100. In other examples, the processor 504 may be located remote from the print apparatus 100 (and the pump 108), and communicate with the pump to perform the above tasks.

The processor 502 may, in some examples, comprise or be similar to the processing circuitry 110 discussed above.

In some examples, the first concentration may comprise a concentration of between around 5% and 100% by weight. In other examples, the first concentration may comprise a concentration of between around 5% and 75% by weight. The second concentration may, in some examples, comprise a concentration of between around 2% and 7% by weight. The defined volume of print agent of the second concentration may, in some examples, comprise a volume of between around 300 cubic centimetres and 600 cubic centimetres.

The machine-readable medium 504 may, in some examples, comprise instructions which, when executed by the processor 502, cause the processor to operate the print apparatus 100 to consume print agent from the print agent tank for delivery to a printable medium. Thus, the processor 502 may control components of the print apparatus 100 to perform a printing operation, such as printing an image onto the printable medium.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print apparatus comprising:

a container-receiving unit for receiving a reusable print agent container;

a print agent reservoir for storing print agent to be consumed by the print apparatus during a printing operation;

a pump for transferring print agent between a reusable print agent container positioned in the container-receiving unit and the print agent reservoir; and processing circuitry to:

operate the pump to transfer print agent of a first concentration from the reusable print agent container to the print agent reservoir; and responsive to determining that a volume of print agent of the first concentration in the reusable print agent container has fallen below a threshold volume, operate the pump to transfer a volume of print agent of a second, lower concentration from the print agent reservoir to the reusable print agent container.

2. A print apparatus according to claim 1, wherein the processing circuitry is further to operate the print apparatus to consume print agent from the print agent reservoir for delivery to a printable substrate.

3. A print apparatus according to claim 2, wherein the processing circuitry is to operate the print apparatus to consume the print agent at a concentration greater than the concentration of the print agent in the reusable print agent container.

4. A print apparatus according to claim 1, wherein the first concentration comprises a concentration of between around 5% and 100% by weight.

5. A print apparatus according to claim 1, wherein the second concentration comprises a concentration of between around 2% and 7% by weight.

6. A print apparatus according to claim 1, wherein the container-receiving unit is structured to releasably receive the reusable print agent container which is also removable.

7. A print apparatus according to claim 1, wherein the print agent reservoir comprises a mixer to adjust concentration of print agent in the print agent reservoir.

8. A method comprising:

providing a reusable print agent canister containing print agent for use in a print apparatus;

transferring print agent of a first concentration from the reusable print agent canister to a print agent tank of the print apparatus for consumption by the print apparatus during a printing operation; and responsive to determining that an amount of print agent of the first concentration in the reusable print agent canister has dropped below a threshold level, transferring print agent of a second, lower concentration from the print agent tank to the reusable print agent canister.

9. A method according to claim 8, further comprising:

performing a printing operation of the print apparatus using the print agent transferred from the reusable print agent canister to the print agent tank.

10. A method according to claim 9, wherein the print agent used for the printing operation is consumed at a concentration higher than the first concentration of the print agent in the reusable print agent canister.

11. A method according to claim 8, further comprising:

removing from the print apparatus the reusable print agent canister containing the print agent of the second concentration;

creating print agent of a third concentration using at least a portion of the print agent of the second concentration;

providing the print agent of the third concentration to the reusable print agent canister.

12. A method according to claim 11, wherein creating print agent of a third concentration comprises combining at least a portion of the print agent of the second concentration, liquid carrier and solid print agent.

13. A method according to claim 12, wherein creating print agent of a third concentration comprises combining the print agent of the second concentration, the liquid carrier and the solid print agent using a high-shear mixer.

14. A method according to claim 8, wherein transferring print agent of the second concentration from the print agent tank to the reusable print agent canister comprises transferring between around 300 cubic centimetres and 600 cubic centimetres of print agent of the second concentration from the print agent tank to the reusable print agent canister.

15. A method according to claim 8, further comprising releasably connecting the reusable print canister, which is also removable, to a receiving unit of the print apparatus before transferring print agent from the canister.

16. A method according to claim 8, further comprising decreasing concentration of the print agent in the print agent tank after receipt from the print agent canister.

17. A method according to claim 8, further comprising transferring the print agent of the second, lower concentration from the print agent tank to the reusable print agent canister to prevent overflow of the print agent tank.

18. A machine-readable medium comprising instructions which, when executed by a processor, cause the processor to:

control a pump to transfer print agent of a first concentration from a reusable print agent container to a print agent tank of a print apparatus for use in a print operation, wherein the print apparatus is to use the print agent at a concentration higher than the first concentration; and in response to determining that the volume of print agent in the reusable print agent container has reduced to below a threshold level, control the pump to transfer a defined volume of print agent of a second concentration from the print agent tank to the reusable print agent container, wherein the second concentration is lower than the first concentration.

19. A machine-readable medium according to claim 18, wherein the first concentration comprises a concentration of between around 5% and 100% by weight;

wherein the second concentration comprises a concentration of between around 2% and 7% by weight; and/or wherein the defined volume of print agent of the second concentration comprises a volume of between around 300 cubic centimetres and 600 cubic centimetres.

20. A machine-readable medium according to claim 18, comprising instructions which, when executed by a processor, cause the processor to:

operate the print apparatus to consume print agent from the print agent tank for delivery to a printable medium.

* * * * *